United States Patent [19]

Russell et al.

[11] Patent Number: 4,521,457

[45] Date of Patent: Jun. 4, 1985

[54] SIMULTANEOUS FORMATION AND DEPOSITION OF MULTIPLE RIBBON-LIKE STREAMS

[75] Inventors: Philip P. Russell, El Cerrito, Calif.; Tyan-Faung Niu, Endwell, N.Y.; Frederic A. Holland, Rochester, N.Y.

[73] Assignee: Xerox Corporation, Stamford, Conn.

[21] Appl. No.: 420,997

[22] Filed: Sep. 21, 1982

[51] Int. Cl.[3] ..... B05D 5/00

[52] U.S. Cl. ..... 427/286; 118/412

[58] Field of Search ..... 427/286, 402, 407.1, 427/293, 289; 118/411, 412

[56] References Cited

U.S. PATENT DOCUMENTS

| | | | |
|---|---|---|---|
| 510,110 | 12/1893 | Biehn . | |
| 1,857,242 | 5/1932 | Edmondson . | |
| 2,031,387 | 2/1936 | Schwarz | 18/8 |
| 3,032,008 | 5/1962 | Land et al. | 118/411 |
| 3,106,481 | 10/1963 | Sorg | 427/286 |
| 3,278,960 | 10/1966 | Nardone | 427/286 |
| 3,508,947 | 4/1970 | Hughes | 430/935 |
| 3,761,552 | 9/1973 | Chill et al. | 264/37 |
| 3,807,918 | 4/1974 | Chill et al. | 425/131 |
| 3,920,862 | 11/1975 | Damschroder et al. | 427/131 |
| 4,162,288 | 7/1979 | Hunt et al. | 264/75 |
| 4,193,752 | 3/1980 | Hunt et al. | 425/131.1 |
| 4,222,979 | 9/1980 | Hunt et al. | 264/75 |
| 4,224,266 | 9/1980 | Hunt et al. | 264/75 |
| 4,387,123 | 6/1983 | Wollam et al. | 427/286 |

FOREIGN PATENT DOCUMENTS 456968 2/1935 United Kingdom .

*Primary Examiner*—Sadie L. Childs

*Attorney, Agent, or Firm*—Peter H. Kondo; John E. Beck; Ronald Zibelli

[57] ABSTRACT

At least one ribbon-like stream of a first coating composition adjacent to and in edge contact with at least one second ribbon-like stream of a second coating composition are deposited on the surface of a support member by establishing relative motion between the surface of the support member and the ribbon-like streams, simultaneously constraining and forming the ribbon-like streams parallel to and closely spaced from each other, contacting adjacent edges of the ribbon-like streams prior to applying the ribbon-like streams to the surface of the support member and thereafter applying the ribbon-like streams to the surface of the support member.

9 Claims, 10 Drawing Figures

SIMULTANEOUS FORMATION AND DEPOSITION OF MULTIPLE RIBBON-LIKE STREAMS

BACKGROUND OF THE INVENTION

This invention relates to processes and apparatus for applying to a surface of a support member at least one ribbon-like stream of a first coating composition adjacent to and in edge contact with at least one second ribbon-like stream of a second coating composition to form a unitary layer on the surface of the support member.

Numerous techniques have been devised to form on a substrate a coating of one composition side-by-side with another coating of a second composition. One of these techniques involves two separate passes of the substrate to permit application of the first coating followed by a second pass to allow application of the second coating. Unfortunately, multiple passes require more time, duplicate handling, and highly sophisticated equipment for alignment of the coatings. Further, where heating of the deposited coatings is necessary for curing or drying, the process may require two separate heating steps. Moreover, multiple passes increase the likelihood of damage to the substrate or coatings, particularly for coated substrates that demand precision tolerances such as flexible photoreceptors for high speed electrostatographic copying and duplicating machines. When multiple pass techniques are utilized to apply side-by-side coatings, it is often difficult to achieve uniform edge to edge contact between the coatings. Moreover, because of overlapping deposits, differences in physical properties including surface tension, and lateral movement of previously or subsequently deposited coatings, a bead frequently forms along the border of side-by-side coatings. This bead causes a ridge to form above the bead as well as in the substrate below the bead when the coated support member is a flexible web which is subsequently rolled for storage, shipment of further processing. This ridge is undesirable in precision machines and can cause adverse effects such as electrical arcing and coating damage due to contact with closely spaced machine components. Moreover, a thick bead at the boundary between side-by-side layers tends to promote the formation of blisters when the coatings are applied as solutions containing volatile solvents. In addition, where fluids are used which have a tendency to spread over each other, the bead acts as a reservoir to promote greater spreading of the fluids over each other.

In order to form side-by-side coatings or webs in a single pass, attempts have been made to extrude coating materials in a common extrusion zone where ribbons of two different coating materials are extruded side-by-side and in contact with each other. Examples of this type of technique are illustrated in U.S. Pat. Nos. 3,807,918 and 3,920,862. However, difficulties have been encountered with these techniques, particularly when materials of different viscosities are employed. For example, when two different materials of significantly different viscosities are introduced into a common chamber and thereafter extruded through a common extrusion zone defined by upper and lower lands of an extrusion die, the higher viscosity material tends to expand into the area occupied by the lower viscosity material thereby causing enlargement of the width of the stream of higher viscosity material and narrowing of the width of the stream of lower viscosity material.

Moreover, difficulty is experienced in achieving uniform edge-to-edge contact between adjacent streams. Attempts to overcome this undesirable characteristic are described in U.S. Pat. No. 3,920,862 wherein one stream of material is introduced on each side of another stream of material to ensure edge contact. Thus the characteristics of common chamber extrusion systems exhibit deficiencies for processes for manufacturing coated articles having precise tolerance requirements.

SUMMARY OF THE INVENTION

It is an object of the invention to provide a process and apparatus to apply to a surface of a support member at least one ribbon-like stream of a first coating composition adjacent to and in edge contact with at least one second ribbon-like stream of a second coating composition wherein the ribbon-like streams are simultaneously constrained and formed parallel to and closely spaced from each other and thereafter contacted along adjacent edges prior to application to the surface of the support member. Because of relative movement between the source of the ribbon-like streams and the surface of the support member, the ribbon-like streams extend in the direction of relative movement of the surface of the support member and the source of the ribbon-like streams to form a continuous unitary layer on the surface of the support member. Since the ribbon-like streams of the coating compositions can be coated simultaneously and continuously on a surface to form a flat surface where the edges of the streams are smooth and in edge-to-edge contact, coated flexible substrates may be rolled without attendant problems caused by beads at the boundaries. Further, because of the uniform and complete edge-to-edge contact achieved, the coatings of this invention are particularly useful for electrical applications such as grounding strips for electrostatographic photoreceptors utilizing multi-active layers. In addition, precise control of the dimensions of the deposited coatings may be achieved even where the viscosity of one of the coating compositions is, for example, ten times greater than the other. Where desired, numerous ribbon-like streams may be applied to a support member in a predetermined spaced relationship to permit subsequent splitting into a plurality of coated articles such as electrostatographic photoreceptor webs having a grounding strip coating along one edge of the web surface.

Obviously, this process may be employed to coat the surface of support members of various configurations including webs, sheets, plates, drums, and the like. The support member may be flexible, rigid, uncoated, precoated, as desired. Also, the coating compositions applied may comprise molten thermoplastic materials, solutions of film forming materials, curable resins and rubbers, and the like.

BRIEF DESCRIPTION OF THE DRAWINGS

A more complete understanding of the process and apparatus of the present invention can be obtained by reference to the accompanying drawings wherein.

DESCRIPTION OF THE PREFERRED EMBODIMENTS

Figure 1:
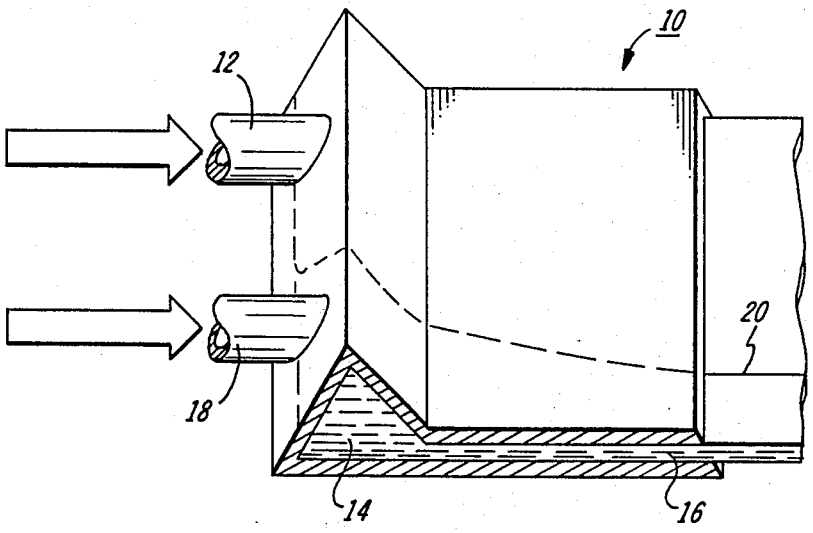
FIG. 1 is a schematic, isometric, sectional view showing one type of apparatus in which different coating compositions are not spaced from each other during formation.

Referring to FIG. 1, a die designated by the numeral 10 is disclosed. This type of die is similar to that described in U.S. Pat. No. 3,920,862 and relates to a technique for coating side-by-side coating compositions on a support. However, in order to fully understand the present invention, a short description of this prior art apparatus follows. In this coating device, a first high viscosity coating composition is continuously moved by a conventional pump (not shown) or other suitable well-known means such as a gas pressure system through an inlet 12 into a common reservoir chamber 14 from which the first coating composition is extruded through a narrow extrusion slot 16. Similarly, a second low viscosity composition is continuously pumped into common reservoir chamber 14 through inlet 18. This latter composition is also extruded through narrow extrusion slot 16. At steady state, the pressure of the high viscosity fluid causes the high viscosity fluid to push toward the low viscosity fluid thereby causing the dimensions of both the high viscosity fluid and the low viscosity fluid to change dramatically while flowing through narrow extrusion slot 16. The dimensional change of the fluids in the narrow extrusion slot 16 is illustrated in FIG. 1 by diagonal borderline 20 between the high viscosity fluid and the low viscosity fluid.

This phenomenon may be described mathematically by equations for the flow of a Newtonian fluid between parallel plates which are separated by a distance 2S as follows:

$$P_1 - P_0 = 3/2 \cdot Q/W \cdot uL/S^3$$

where $P_1$ equals reservoir chamber pressure, $P_0$ equals atmospheric pressure, Q equals volumetric flow rate, W equals fluid stream width, u equals viscosity, L equals land length, and S equals one-half slot opening. If Q/W, L and S are selected to initially be the same for both fluids, and if the viscosity of one fluid is 5 times greater than the other, $(P_1 - P_0)$ for the high viscosity fluid will be 5 times as large as $(P_1 - P_0)$ for the low viscosity fluid. Thus, $P_1$ for the high viscosity fluid is greater than $P_1$ for the low viscosity fluid, and there will be a cross flow within the narrow extrusion slot of the die. The larger pressure $P_1$ of the high viscosity fluid causes the high viscosity fluid to expand and push the low viscosity fluid over toward the low viscosity fluid side of the die. The flow rate per unit width and consequently the wet thickness of the low viscosity fluid would be five times as great as for the high viscosity fluid. This result is general, and can be summarized by the following equation:

$$\frac{Q_{LV}/W_{LV}}{Q_{HV}/W_{HV}} \approx u_{HV}/u_{LV}$$

where $Q_{LV}$ and $Q_{HV}$ are the volumetric flow rates of the low viscosity and high viscosity fluids, respectively, and $W_{LV}$ and $W_{HV}$ are the fluid stream widths of the low and high viscosity fluids, respectively, at the outlet of the narrow extrusion slot of the die. $u_{LV}$ and $u_{HV}$ are the viscosities of the low viscosity and high viscosity fluids, respectively. Thus we can explain the effects achieved by separating the two fluids in the reservoir chamber and in the narrow extrusion slot of the die.

Figure 2:
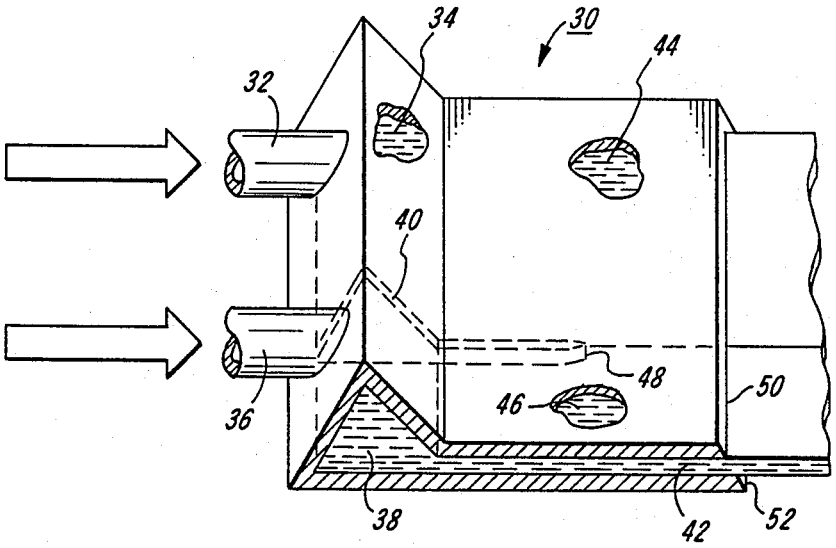
FIG. 2 is a schematic, isometric, sectional view of apparatus in which ribbon-like streams of two different coating compositions are formed parallel to and spaced from each other.

In FIG. 2, a die 30 is shown which is similar to the die 10 depicted in FIG. 1. This die 30 has an inlet 32 through which a coating composition may be introduced into a reservoir chamber 34 (shown through a cut-away opening). A second coating composition is introduced through inlet 36 into reservoir chamber 38. Unlike the common reservoir chamber 14 in die 10 illustrated in FIG. 1, the high viscosity composition and the low viscosity composition introduced into the die 30 shown in FIG. 2 are collected in separate chambers 34 and 38, respectively. Reservoir chambers 34 and 38 are separated by spacing member 40. In addition to separating reservoir chambers 34 and 38, spacing member 40 also extends into narrow extrusion slot 42. Spacing member 40 is extended a sufficient distance into narrow extrusion slot 42 to ensure formation of a ribbon-like stream 44 having a uniform width within narrow extrusion slot 42 and a ribbon-like stream 46 having a uniform width within narrow extrusion slot 42. The length of narrow extrusion slot 42 and the length of the spacing member 40 in narrow extrusion slot 42 should be sufficiently long to also ensure laminar flow and substantial equalization of pressure of the coating compositions prior to joining of the ribbon-like stream 44 and ribbon-like stream 46 which in turn ensures prevention of cross-flow in the narrow extrusion slot 42. Although the downstream edge 48 of the spacing member 40 is shown as a knife edge, satisfactory results may be achieved with other shapes such as a squared edge similar to lip end 50 or lip end 52 depicted in FIG. 2. Unlike the streams of non-uniform width obtained with die 10 shown in FIG. 1, ribbon-like streams of uniform width are obtained with the die 30 illustrated in FIG. 2 when spacing member 40 is utilized. The number, widths, thickness, and the like of the ribbon-like streams can be varied in accordance with factors such as the number of articles desired and width of the support surface on which the composition is applied.

Figure 3A:
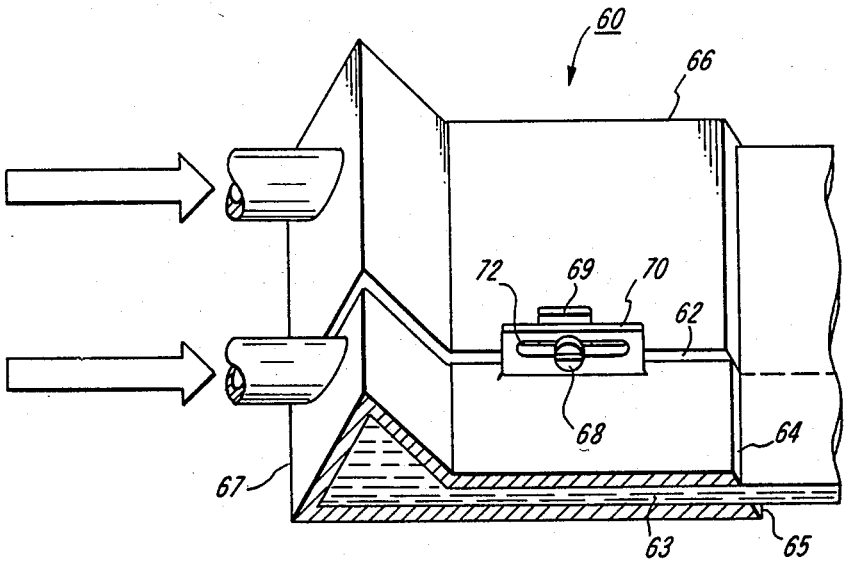
FIG. 3*a* is a schematic, isometric, sectional view of another embodiment in which ribbon-like streams of two different coating compositions are formed parallel to and spaced from each other.

In FIG. 3*a*, a die assembly 60 is shown in which the spacing member 62 extends through the entire length of the narrow extrusion slot 64 to lip ends 64 and 65. Satisfactory results with parallel ribbon-like streams are achieved with this configuration. Although two die sections 66 and 67 are shown in FIG. 3, more than two separate side-by-side dies sections may be utilized if desired. When separate die sections are utilized for each ribbon-like stream, it is preferred that each side of each die facing each spacing member be open and that suitable thin material such as shimstock be sandwiched between each adjacent die section to separate the ribbon-like streams to ensure that the spacing member is sufficiently thin to minimize or prevent turbulence in adjacent ribbon-like streams at the point where the streams are joined. Any suitable means may be utilized to fasten the separate die sections 66 and 67 together such as screw 68 which screws into threaded lug 69 of die section 66 thereby securing lug 70 of die section 67 to lug 69. Similarly lugs (not shown) on the underside of die assembly 60 can also be used to join die sections 66 and 67. A slot 72 in lug 70 permits adjustments to be made for die section 67 relative to the position of die section 66. Although the narrow extrusion slot 63 illustrated in FIG. 3*a* is the same height for both the high viscosity ribbon-like material in die section 66 and low viscosity ribbon-like material in die section 67, a height difference between adjacent dies may be utilized if desired. The use of different heights may result in unequal wet coating thicknesses on the support surface. Generally speaking, spacing member 62 will extend all the way to lip ends 64 and 65 for narrow extrusion slots having relatively short stream lengths.

Figure 3B:
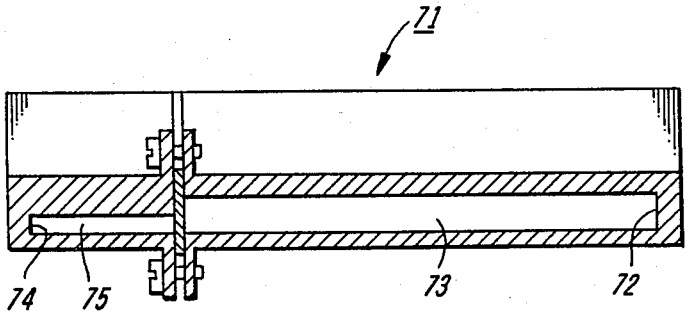
FIG. 3*b* is a schematic, isometric, sectional view of another embodiment in which one ribbon-like stream of one coating composition is thicker than another parallel and spaced ribbon-like stream of a different coating composition.

In FIG. 3*b*, a frontal view of die assembly 71 is shown in which the height 72 of narrow extrusion slot 73 for one ribbon-like stream is higher than the height 74 of narrow extrusion slot 75 for another parallel ribbon-like stream for depositing ribbon-like streams having different wet thicknesses in edge-to-edge contact. Such an arrangement permits the same dried coating thicknesses to be obtained for adjacent ribbon-like streams of coating solutions or dispersions having different solids contents.

Figure 3C:
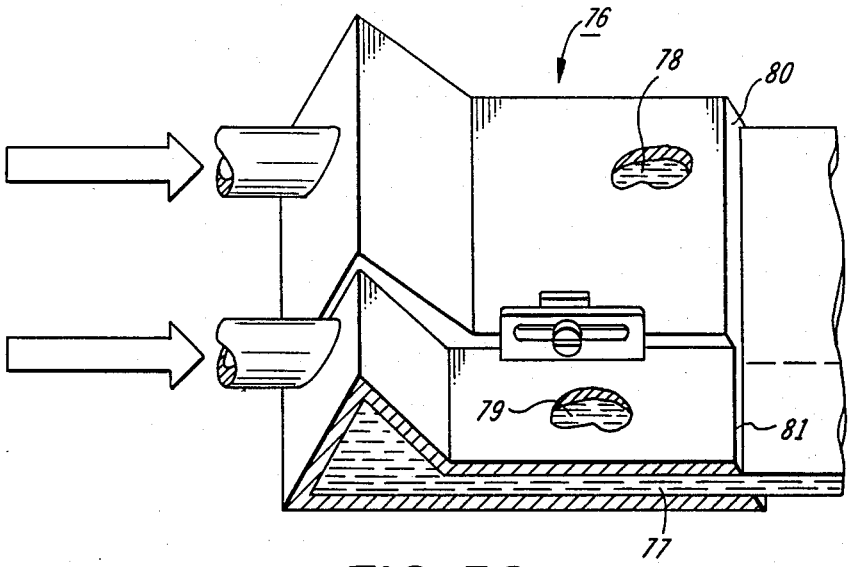
FIG. 3*c* is a schematic, isometric, sectional view of another embodiment in which one ribbon-like stream of one coating composition is longer than another parallel and spaced ribbon-like stream of a different coating composition.

In FIG. 3*c*, a die assembly 76 is shown in which the length of narrow extrusion slot 77 for ribbon-like stream 78 (shown through a cut-away opening) is shorter than the length of narrow extrusion slot 77 for ribbon-like stream 79 (shown through a cut-away opening). This configuration permits the outlet ends 80 and 81 for ribbon-like streams of different lengths to be positioned equidistant from the surface of a support to be coated.

Figure 4:
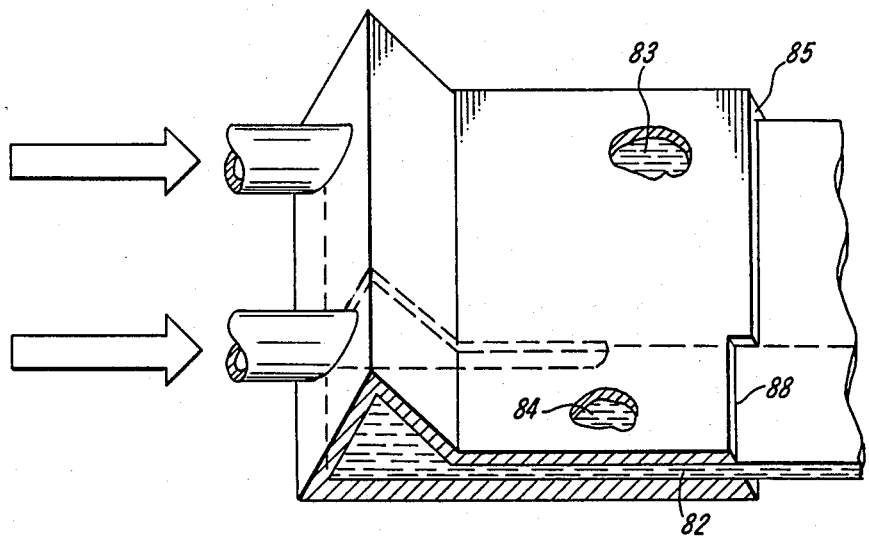
FIG. 4 is a schematic, isometric, sectional view of still another embodiment in which ribbon-like streams of two different coating compositions are formed parallel to and spaced from each other and in which one ribbon-like stream is constrained for a shorter distance than the other stream.

In FIG. 4, the length of narrow extrusion slot 82 for ribbon-like stream 83 (shown through a cut-away opening) is longer than the length of narrow extension slot 82 for ribbon-like stream 84 (shown through a cut-away opening). This configuration permits the outlet 85 for ribbon-like stream 83 to be positioned so that the outlet 85 for ribbon-like stream 83 is positioned closer to the surface of a support to be coated than outlet 88 for ribbon-like stream 84. If desired, the narrow extrusion slot 82 for longer ribbon-like stream 83 may be positioned so that the outlet 85 for ribbon-like stream 83 is closer to the surface of a support to be coated (not shown) than outlet 88 for ribbon-like stream 84. This will, of course, position any reservoir chamber for the longer ribbon-like stream at a different distance from a support surface than an adjacent reservoir chamber for an adjacent ribbon-like stream. Such an arrangement of reservoirs is illustrated in FIG. 3*c*. Control of the distance of each narrow extrusion slot outlet from a support surface enables the ribbon-like streams to bridge the gap between each narrow extrusion slot outlet and the support surface regardless of large differences in viscosity between adjacent ribbon-like streams. Generally, it is preferred to position the narrow extrusion slot outlet for lower viscosity ribbon-like streams closer to the support surface than the narrow extrusion slot outlet for higher viscosity ribbon-like streams to form a bead of coating material which functions as a reservoir for greater control of coating deposition.

Figure 5:
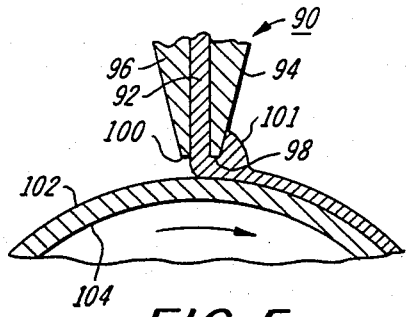
FIG. 5 is a schematic, sectional view of ribbon-like streams of coating material applied from a die means of this invention to the surface of a support member where the coating material forms a bead on the downstream side of the die means.

In FIG. 5, the downstream end of a die 90 is illustrated in which narrow extrusion slot 92 is formed between lips 94 and 96. The lip ends 98 and 100 are spaced from the surface 102 of a support member 104 moving in the direction depicted by the arrow. The rate of flow of the coating compositions through narrow extrusion slot 92, the distance between die lip ends 98 and 100 from the surface 102 of support member 104 and the relative rate of movement between surface 102 and die 90 are adjusted to form a bead 101 of the coating material under downstream lip end 98. Although the thickness of the ribbon-like stream of coating materials is momentarily altered at this point during the coating process, good uniform coatings on the surface 102 are obtained.

Figure 6:
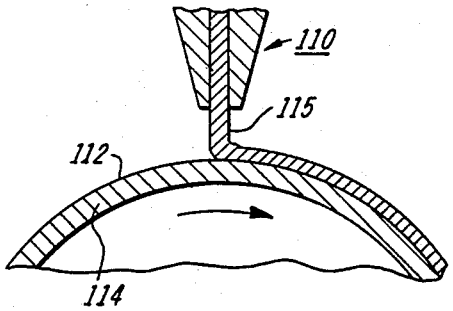
FIG. 6 is a schematic, sectional view of ribbon-like streams of coating material applied from a die means of this invention to the surface of a support member where the ribbon-like stream is a free-falling ribbon.

In FIG. 6, the distance between die 110 and the surface 112 of support member 114, flow rate of the coating material 115, and relative speed between the die 110 and surface 112 are adjusted to allow the coating material to fall by gravity onto surface 112 without splashing or puddling to form uniform coatings on surface 112.

Figure 7:
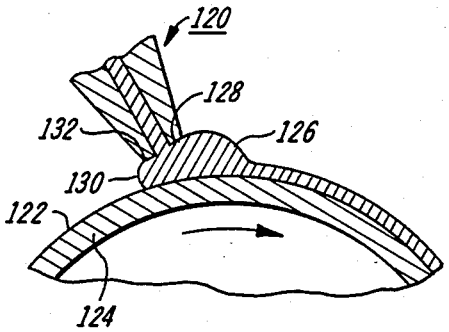
FIG. 7 is a schematic, sectional view of ribbon-like streams of coating material applied from a die means of this invention to the surface of a support member where beads of coating material are formed upstream and downstream of the die means.

In FIG. 7, the distance between die 120 and surface 122 of support member 124, flow rate of the composition and relative speed between the die 120 and surface 122 are controlled to form a bead 126 under the downstream die lip end 128 and bead 130 under upstream die lip end 132. Satisfactory uniform coatings are obtained with this arrangement also. The flow rate for this embodiment is greater than that shown in FIG. 5 if all other materials and conditions are the same.

Figure 8:
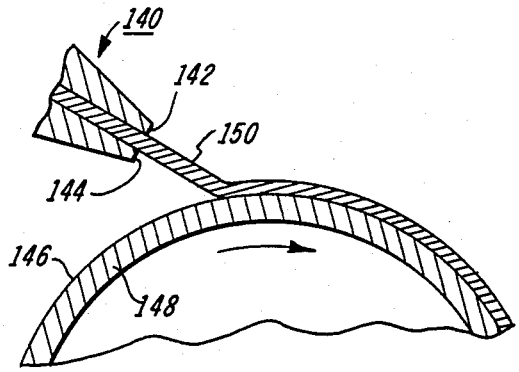
FIG. 8 is a schematic, sectional view of ribbon-like streams of coating material applied from a die means of this invention to the surface of a support member where the ribbon-like material forms a unitary unsupported stream prior to contacting the surface of the support member.

In FIG. 8, the flow rate of coating compositions through die 140, the distance between die lip ends 142 and 144 from the surface 146 of support member 148 and the relative speed between the die 140 and surface 146 are adjusted to provide an unsupported ribbon-like stream of coating materials 150 to project from die lip ends 142 and 144 to the surface 146 of support member 148. This technique also provides good uniform coatings on the surface 146 of support member 148.

The die lip ends may be of any suitable configuration including squared, knife and the like. A flat squared end is preferred for the bead coating embodiments illustrated, for example, in FIGS. 5 and 7, particularly for high viscosity fluids. The flat die lip ends appear to support and stabilize the beads during bead coating operations.

Although reservoirs are depicted in all of the figures above, one may, if desired, eliminate the reservoirs and feed the coating composition directly into the divided narrow extrusion slots. However, more uniform feeding occurs when reservoirs are utilized for high viscosity compositions. Also, multiple inlets with multiple reservoir chambers may be utilized to apply a plurality of ribbon-like streams on a wide support member which may thereafter be split in a longitudinal direction to provide plurality of coated elements having side by side coatings.

The width of the spacing member depends upon viscosity, flow rates, and length of the narrow extrusion slot. If the spacing member is too wide, adjacent edges of the ribbon-like streams will be too widely separated and will not uniformly contact each other prior to application to a support member. Generally, it is believed that satisfactory results may be achieved with spacing members having a width less than about 100 micrometers. Spacing members having a width between about 25 microns and about 75 microns are preferred for more uniform contact between the edges of the ribbon-like streams. Spacing member width less than about 25 micrometers may not possess sufficient strength where significant viscosity differences exist between adjacent ribbon-like streams requiring high pressure to extrude the high viscosity composition and relatively low pressure to extrude the low viscosity composition into the narrow extrusion slots. Optimum results may be obtained with a spacing member width of about 50 micrometers. As indicated above, the end of the spacing member may have a knife edge or even be squared with no noticable difference in results. The length of the spacing member should be sufficient to achieve laminar flow and substantial equalization of pressure between adjacent ribbon-like streams by the time the ribbon-like streams are brought into contact with each other.

The selection of the narrow extrusion slot height generally depends upon factors such as the fluid viscosity, flow rate, distance to the surface of the support member, relative movement between the die and the substrate and the thickness of the coating desired. Generally, satisfactory results may be achieved with slot heights between about 25 micrometers and about 750 micrometers. It is believed, however, that heights greater than 750 micrometers will also provide satisfactory results. Good coating results have been achieved with slot heights between about 100 micrometers and about 250 micrometers. Optimum control of coating uniformity and edge to edge contact are achieved with slot heights between about 150 micrometers and about 200 micrometers.

The roof, sides and floor of the narrow extrusion slot should preferably be parallel and smooth to ensure achievement of laminar flow. The length of the narrow extrusion slot from the entrance opening to the outlet opening should be at least as long as the spacing member to ensure achievement of laminar flow and substantial equalization of pressure between adjacent ribbon-like streams by the time the stream edges contact each other.

The gap distance between the die lip ends and the surface of the supporting substrate depends upon variables such as viscosity of the coating material, the velocity of the coating material and the angle of the narrow extrusion slot relative to the surface of the support member. Generally speaking, a smaller gap is desirable for lower flow rates. The distance between the die lip ends and the surface of the support member is shortest when bead coating is illustrated in FIGS. 5 and 7 are utilized. A greater distance may be employed with jet coating as illustrated in FIG. 8. Maximum distance between the die lip ends and the surface of the substrate member may be achieved with curtain coating as shown in FIG. 6. Regardless of the technique employed, the flow rate and distance should be regulated to avoid splashing, dripping, puddling of the coating material.

Relative speeds between the coating die and the surface of the support member up to about 200 feet per minute have been tested. However, it is believed that greater relative speeds may be utilized if desired. The relative speed should be controlled in accordance with the flow velocities of the ribbon-like streams. In other words, curtain coating and bead coating will normally call for less relative speed than jet coating.

The flow velocities or flow rate per unit width of the narrow extrusion slot for each ribbon-like stream should be sufficient to fill the die to prevent dribbling and to bridge the gap as a continuous stream to the surface of the support member. However, the flow velocity should not exceed the point where non-uniform coating thicknesses are obtained due to splashing or puddling of the coating composition. Varying the die to support member surface distance and the relative die to support member surface speed will help compensate for high or low coating composition flow velocities. Surprisingly, the flow velocities or flow rate per unit width of the narrow extrusion slot for adjacent ribbon-like streams need not be the same by the time the streams are brought together prior to or at the outlet of the narrow extrusion slot.

The coating technique of this invention can accommodate an unexpectedly wide range of coating compositions viscosities from viscosities comparable to that of water to viscosities of molten waxes and molten thermoplastic resins. Generally, lower coating composition viscosities tend to form thinner wet coatings whereas coating compositions having high viscosities tend to form thicker wet coatings. Obviously, wet coating thickness will form thin dry coatings when the coating compositions employed are in the form of solutions, dispersions or emulsions. Due to the simultaneous constraining and forming of at least two ribbon-like streams parallel to and closely spaced from each other followed by contacting the ribbon-like streams along adjacent edges prior to application to the surface of the support member, coating compositions whose viscosities differ by as much as as a factor of 10 may be readily coated at any desired strip width regardless of the desired flow rates per unit width of the narrow extrusion slot.

The pressures utilized to extrude the coating compositions through the narrow extrusion slots depends upon the size of the slot, viscosities of the coating compositions and whether curtain, bead or jet deposition is contemplated. Where the viscosities of the coating compostions are substantially the same, the pressures employed to extrude the coating compostions may be substantially the same. However, if there is a substantial difference between adjacent coating composition viscosities, a higher pressure should be used for the higher viscosity coating composition. In any case, to avoid alteration of stream dimensions, the pressures of adjacent ribbon-like streams of coating compositions should be substantially the same at the point where they join.

Any suitable temperature may be employed in the coating deposition process. Generally, ambient temperatures are preferred for deposition of solution coatings. However, higher temperatures may be necessary for depositing coatings such as hot melt coatings.

In selecting compositions for adjacent ribbon-like streams, similar surface tensions in the compositions are desirable to achieve an equal amount of spreading. The degree of migration of material in each ribbon-like stream is reduced as the surface tensions of each of the fluids become more nearly equal to each other. Similarly, surface tensions of the coating composition materials in adjacent ribbon-like streams should be selected so that they each wet the other rather than repel the other. This wetting characteristic is desirable to achieve distinct linear boundaries and to avoid ragged boundaries in which adjacent materials fail to uniformly contact each other along the boundaries. Generally, where coating solutions are utilized, similar solvents in adjacent coating compositions are preferred. For example, the use of water as a solvent in one ribbon-like stream and ethyl alcohol as a solvent in the adjacent ribbon-like stream provide good border definition.

To achieve the improved results of this invention, it is important that when adjacent edges of the ribbon-like streams are brought into contact with each other, the ribbon-like streams are fully preformed, are moving parallel and edge-to-edge with each other under laminar flow conditions, and are at substantially the same pressure.

A number of examples are set forth hereinbelow and are illustrative of different compositions and conditions that can be utilized in practicing the invention. All proportions are by weight unless otherwise specified. It will be apparent, however, that the invention can be practiced with many types of compositions and can have many different uses in accordance with the disclosure above and as pointed out hereinafter.

EXAMPLE I

A conductive coating composition was prepared comprising about 71 grams of carbon black, about 85 grams of polyester resin and about 844 grams of methylene chloride solvent. This mixture had a surface tension of about 33 dyne/cm and a viscosity of about 125 cp. A second coating composition was prepared containing about 85 grams of an alkylidene diarylene, about 85 grams of polycarbonate resin, (Makrolon, available from Mobay Chemical Company) and about 830 grams of methylene chloride solvent. This second composition had a surface tension of about 32 dynes/cm and a viscosity of about 600 cp. These coating compositions were applied as two spaced apart, parallel, side-by-side, ribbon-like streams by means of an extrusion die similar to the die illustrated in FIG. 2 to an aluminized polyethylene terephthalate film coated with a polyester coating. The film was transported beneath the die at about 21 meters per minute. The length, width, and height of the narrow extrusion slot in the die for each ribbon-like stream was about 9.5 mm, 46 mm, and 508 micrometers respectively. The length and width of the spacer in the narrow extrusion slot were about 8.9 mm and 670 micrometers, respectively. The end of the spacer where the ribbon-like streams were joined was sharpened to a knife edge. The deposited coating was dried in a first zone at about 57° C. and thereafter dried in a second zone at about 135° C. Although these drying conditions were severe, no blistering was observed at the ribbon-ribbon boundary of the dried coating. The deposited dried coatings had excellent edge-to-edge contact and a well defined ribbon-ribbon boundary. Further there was no ridge at the boundary between the deposited coatings which could be detected by touch.

EXAMPLES II–V

A first coating composition was prepared comprising about 190 grams of submicron selenium particles, about 140 grams of polyvinyl carbazole, about 140 grams of an alkylidene diarylene and about 260 grams of tetrahydrofuran solvent. A second coating composition was prepared containing about 0.5 gram of polyester resin, about 90 grams of polycarbonate resin and about 910 grams of methylene chloride solvent. These coating compositions were applied as two side-by-side ribbon-like streams by means of an extrusion die similar to the die illustrated in FIG. 2 to a polyethylene terephthalate film transported beneath the die. The length, width, and height of the narrow extrusion slot in the die for each ribbon-like stream was about 9.5 mm, 46 mm, and 508 micrometers respectively. The length and width of the spacer in the narrow extrusion slot were about 8.9 mm and 670 micrometers, respectively. The end of the spacer where the ribbon-like streams were joined was sharpened to a knife edge. Four different runs were conducted at different flow rates as follows:

| | FIRST COATING | | SECOND COATING | |
|---|---|---|---|---|
| EXAMPLES | FLOW | THICKNESS | FLOW | THICKNESS |
| II | 0.111 | 109 | 0.163 | 160 |
| III | 0.123 | 121 | 0.114 | 112 |
| IV | 0.121 | 119 | 0.172 | 169 |
| V | 0.375 | 368 | 0.226 | 222 |

In the chart above, flow rate units for the coatings were in $cm^3$/sec-cm and the wet thickness units for the deposited coatings were in micrometers. The gap between the die ends and the film surface was adjusted to form a stable bead as illustrated in FIG. 5. The minimum flow rate was that at which a stable bead could be formed. The maximum gap was that at which the least stable of the two coatings could form a stable bead. When the flow rate for the second coating was increased above about 0.226 $cm^3$/sec-cm puddle coating resulted. The deposited coatings were dried in a first zone at about 57° C. and thereafter dried in a zone at about 135° C. Although the first coating migrated over the second coating about 3 mm, successful coatings were made in Examples I through V with the ribbon-ribbon boundary being smooth to the touch with no noticeable edge bead ridge. Further there was no ridge at the boundary between the coatings which could be detectable by touch. No blistering was observed at the ribbon-ribbon boundary of the dried coating.

EXAMPLE VI

A first coating composition was prepared comprising about 7 grams of cellulose resin, about 53 grams of polycarbonate resin, about 24 grams of graphite pigment and about 916 grams of a 1,1,1 trichloroethane/methylene chloride solvent mixture. This mixture had a surface tension of about 28 dyne/cm and a viscosity of about 400 cp. A second coating composition was prepared containing about 85 grams of an alkylidene diarylene, about 85 grams of polycarbonate resin, (Makrolon, available from Mobay Chemical Company) and about 830 grams of methylene chloride solvent. This second composition had a surface tension of about 32 dynes/cm and a viscosity of about 600 cp. These coating compositions were applied as two spaced apart, parallel, side-by-side, ribbon-like streams by means of an extrusion die similar to the die illustrated in FIG. 2 to an aluminized polyethylene terephthalate film coated with a polyester coating. The film was transported beneath the die at about 12 meters per minute. The length, width, and height of the narrow extrusion slot in the die for each ribbon-like stream was about 9.5 mm, 21 mm, and 457 micrometers respectively. The length and width of the spacer in the narrow extrusion slot were about 9.5 mm and 51 micrometers, respectively. The end of the spacer where the ribbon-like streams were joined had a squared edge. The deposited coating was dried at progressively increasing temperatures in 4 zones from about 130° C. to about 290° C. The deposited dried coating had a well defined ribbon-ribbon boundary. No blistering was observed at the ribbon-ribbon boundary. Further, there was no ridge at the boundary between the deposited coatings which could be detected by touch.

EXAMPLE VII

The procedures described in Example VI were repeated except that a coating composition comprising about 7 grams of cellulose resin, about 53 grams of polycarbonate resin, about 24 grams of graphite pigment, and about 916 grams of methylene chloride solvent having a surface tension of about 30 dynes/cm and a viscosity of about 700 cp was substituted for the first coating composition. The deposited dried coating had a well defined ribbon-ribbon boundary and no blistering was observed at the ribbon-ribbon boundary. Further, there was no ridge at the boundary between the deposited coatings which could be detected by touch.

EXAMPLE VIII

The procedures described in Example VI were repeated except that a spacer having a length and width of about 9.5 mm and 127 micrometers, respectively, was substituted for the spacer used in Example VI. The end of the spacer where the ribbon-like streams were joined had a squared edge. The deposited dried coating had a well defined ribbon-ribbon boundary. No blistering was observed at the ribbon-ribbon boundary. Further, there was no ridge at the boundary between the deposited coatings which could be detected by touch.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. A process for applying to a surface of a support member at least one ribbon-like stream of a first coating composition side-by-side to and in edge contact with at least one second ribbon-like stream of a second coating composition comprising providing a source for said ribbon-like streams, establishing relative motion between said surface of said support member and said source of said ribbon-like streams, simultaneously constraining and forming said ribbon-like streams parallel to, side-by-side to and spaced from each other, contacting adjacent edges of said ribbon-like streams prior to applying said ribbon-like streams to said surface of said support member, and continuously applying said ribbon-like streams to said surface of said support member whereby said ribbon-like streams extend in the direction of relative movement of said surface of said support member and said source of said ribbon-like streams to form a continuous unitary layer having a boundary between said side-by-side ribbon-like streams on said surface of said support member.

2. A process according to claim 1 including maintaining the spacing between said ribbon-like streams less than about 100 micrometers while simultaneously constraining and forming said ribbon-like streams parallel to and spaced from each other.

3. A process according to claim 2 including maintaining the spacing between said ribbon-like streams between about 25 micrometers and about 75 micrometers while simultaneously constraining and forming said ribbon-like streams parallel to and spaced from each other.

4. A process according to claim 1 including equalizing the pressure between each of said ribbon-like streams while simultaneously constraining and forming said ribbon-like streams parallel to and spaced from each other.

5. A process according to claim 1 wherein the viscosity of said first coating composition is greater than the viscosity of said second coating composition by a factor up to about 10.

6. A process according to claim 1 including maintaining laminar flow in said ribbon-like streams when contacting adjacent edges of said ribbon-like streams prior to applying said ribbon-like streams to said surface of said support member.

7. A process according to claim 1 including maintaining the thickness of said ribbon-like streams between about 25 micrometers and about 750 micrometers while simultaneously constraining and forming said ribbon-like streams parallel to and spaced from each other.

8. A process according to claim 7 including maintaining the thickness of said ribbon-like streams between about 100 micrometers and about 250 micrometers while simultaneously constraining and forming said ribbon-like streams parallel to and spaced from each other.

9. A process according to claim 7 including maintaining the thickness of said ribbon-like streams between about 150 micrometers and about 200 micrometers while simultaneously constraining and forming said ribbon-like streams parallel to and spaced from each other.

* * * * *